United States Patent [19]

Lee

[11] Patent Number: 4,596,059

[45] Date of Patent: Jun. 24, 1986

[54] AUTOMATIC DUST-REMOVING ERASER OF A ROLLING-FRICTION TYPE FOR BLACKBOARD

[76] Inventor: Wen-Chin Lee, No. 5, Lane 93, Hsing-Lin Road, Hsi Tun District, Tai-Chung City, Taiwan

[21] Appl. No.: 562,184

[22] Filed: Dec. 16, 1983

[30] Foreign Application Priority Data

Dec. 20, 1982 [GB] United Kingdom ..... 8236162

[51] Int. Cl.[4] ..... B43L 21/00

[52] U.S. Cl. ..... 15/98; 15/27; 15/97 R; 15/221; 434/417

[58] Field of Search ..... 15/97 R, 98, 210 R, 15/221, 219, 220 R, 27; 434/417

[56] References Cited

U.S. PATENT DOCUMENTS

| | | | |
|---|---|---|---|
| 1,487,052 | 3/1924 | Enomoto | 15/210 R |
| 4,080,683 | 3/1978 | Yi | 15/98 |
| 4,462,134 | 7/1984 | Wang | 15/98 |

FOREIGN PATENT DOCUMENTS

| | | | |
|---|---|---|---|
| 2090123 | 7/1982 | United Kingdom | 15/210 R |

*Primary Examiner*—Edward L. Roberts

*Attorney, Agent, or Firm*—Lowe, King, Price & Becker

[57] ABSTRACT

An automatic dust-removing eraser of a rolling-friction type for use on a blackboard includes: a casing body having an open section or cavity in the central portion; a plurality of different guiding slots vertically formed at both ends of the side walls defining the open section; a spare space provided at each end portion with an escape clack valve and a discharge door respectively disposed in the opposing side walls defining the spare spaces; a pair of supporting members each having integrally-linked parallel plates respectively secured in the guiding slots of the casing body; and a plurality of master rollers and slave rollers mounted within the cavity in interrelated coupling; so that, by means of the matched rotation of the master and slave rollers and the unilateral check action effected from the supporting members, the chalk dust gathered by the master rollers over the surface of the blackboard is automatically removed through self-brushing and discharging action of the slave rollers.

7 Claims, 4 Drawing Figures

AUTOMATIC DUST-REMOVING ERASER OF A ROLLING-FRICTION TYPE FOR BLACKBOARD

BACKGROUND OF THE INVENTION

This invention relates to an automatic dust-removing eraser for blackboards, and in particular to an eraser arrangement for easily and automatically removing the chalk dust on the surface of a blackboard without sprinkling the dust and beating the eraser.

Conventionally, all known felt-pad blackboard erasers have to be beaten periodically to remove the chalk dust from the eraser following prolonged use. This dust-removing method through constant beating of the eraser is inconvenient and troublesome. To overcome the above-noted defect, an electrical eraser is known for removing chalk dust by means of electrical vibrations. However, electrical erasers are generally bulky and do not completely remove blackboard chalk dust.

SUMMARY OF THE INVENTION

It is accordingly an object of this invention to provide an automatic dust removing eraser with master and slave rolling means arranged in a rolling-friction type arrangement with spare spaces for dust storing and discharging action so that the eraser can be continuously used in erasing without beating the dust from the eraser.

It is another object of this invention to provide an automatic dust-removing eraser of reduced weight, that is easy to use and of long life.

According to the present invention, these and other objects can be achieved by providing an automatic dust-eraser of a rolling-friction type for the blackboard, which comprises a casing having an open central section, a plurality of different guiding slots and cotter holes formed at both ends of side walls defining the open section thereof, and a spare space separately provided at each end portion of the casing with an escape clack valve and a discharge door respectively disposed on opposing end walls defining the spare spaces. A pair of supporting members each having a horizontal parallel plate and vertical parallel plate integrally formed therewith are laterally secured in the guiding slots at both ends of the open section in the casing. A plurality of cylindrical master rolling members, together with a plurality of columnar slave rolling members, are disposed justaposed to the parallel plates over the open section of the casing in a parallel interrelated coupling to effect automatic dust-removing action through the interrelated rotation of both rolling members during the erasing operation.

These objects and advantages of the present invention will become apparent from the following description referring to a preferred embodiment when read in conjunction with the accompanying drawings.

DETAILED DESCRIPTION OF THE PREFERRED EMBODIMENT

Figure 1:
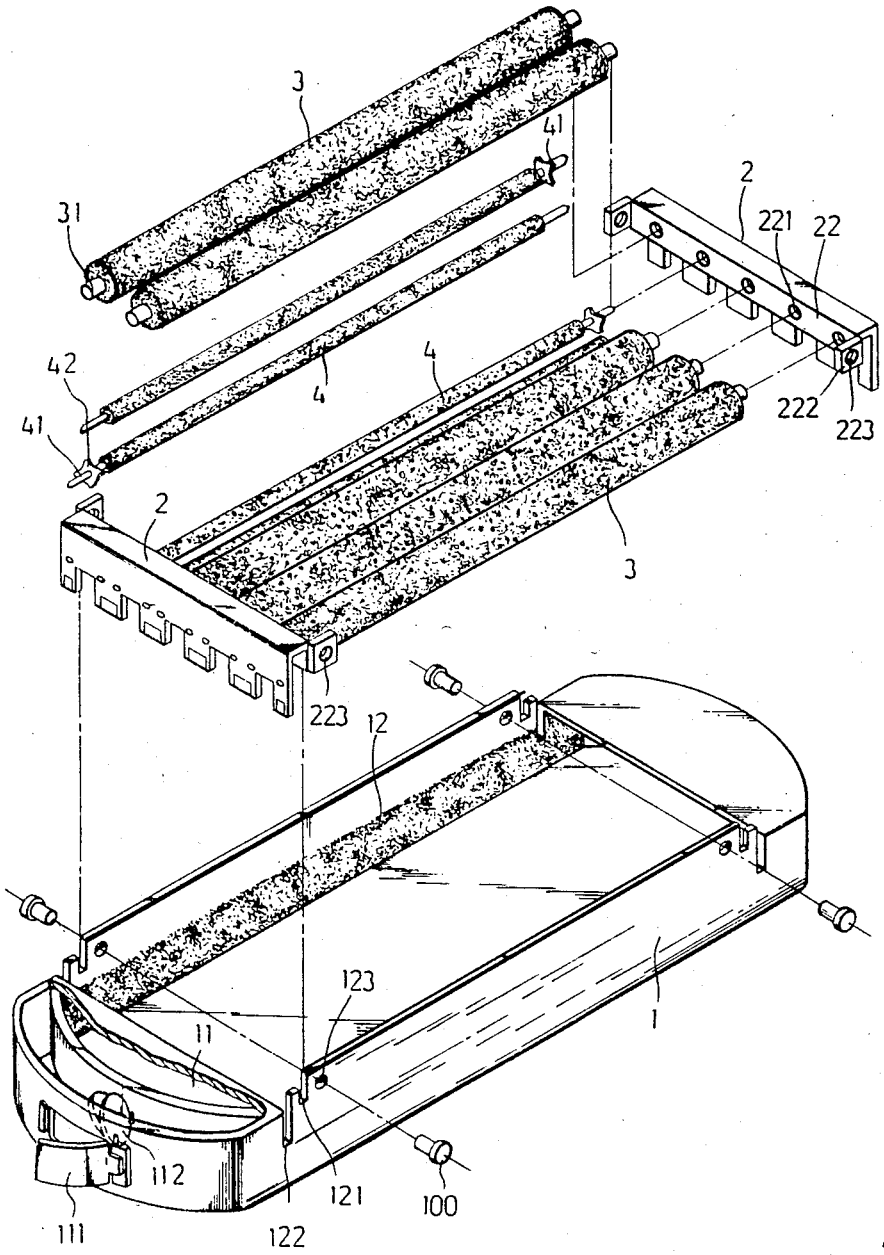
FIG. 1 is a perspective view of the preferred embodiment of an automatic dust-removing eraser of a rolling-friction type for a blackboard according to this invention.
Figure 2:
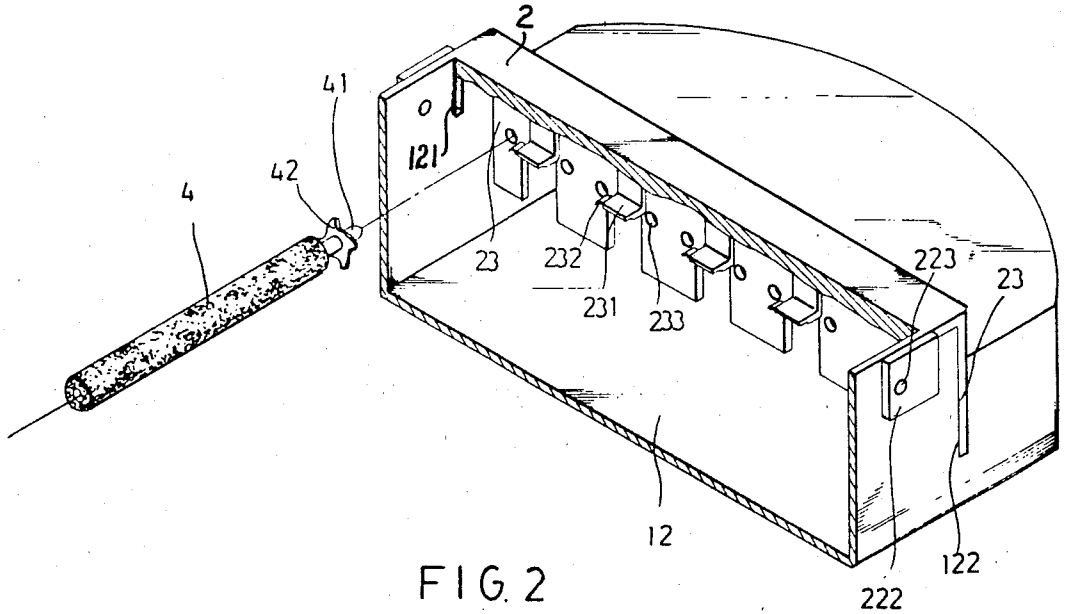
FIG. 2 is a partial cross sectional view of the embodiment in FIG. 1.

Referring to FIGS. 1 and 2, the preferred embodiment of an automatic dust-removing eraser of a rolling-friction type for a blackboard according to this invention comprises a planar elliptical casing body 1 having an oblong open section 12 in the central portion, a plurality of guiding slots 121 and 122 of different lengths and cotter holes 123 formed at both ends at the side walls defining the oblong open section 12. A closed spare space 11 is provided at each end portion with a discharge door 111 and an escape clack valve 112 respectively provided in the opposing side walls defining the spare space 11 thereof. A pair of supporting members 2 are respectively fixed at both ends of the open section 12 through the guiding slots 121 and 122; and a plurality of cylindrical master rolling members 3 and columnar slave rolling members 4 are mounted on the supporting members over the open section 12 in a parallel interrelated coupling so as to form a closed rolling-friction structure for automatic dust-removing operation.

As shown in FIGS. 1 and 2, each of the supporting members 2 includes a horizontal plate 22 having a plurality of evenly spaced orifices 221 integrally formed therein, a vertical plate 23 integrally linked with a horizontal plate 22 and provided with toothed portions at the lower end, and a connecting lug 222 with a cotter hole 223 in the center provided at both ends of the plate 22 for overlapping with the cotter holes 123 in the casing 1 and secured by screw bolts 100 thereat. In addition, each of the master rolling members 3 has a journal 31 integrally formed at both ends, and each of the slave rolling members 4 also has a journal 41 at each end with a reversing member 42 fixed thereat. The plate 23 is slightly longer than the horizontal plate 22, and is secured in the guiding slot 122 in the casing 1. As shown in FIG. 2, the vertical plate 23 has toothed portions at the lower end with a plurality of spaced orifices 233 formed therein. A plurality of protruding support projections 231 each have a movable check piece 232 movably provided at one side with a spring (not shown) for allowing the check pieces to move in a reversible semicircular direction. The pieces 232 are installed on the projections 231 along the spaces between orifices 233. When the journals 41 of the slave rolling members 4 are respectively disposed in the orifices 233, the reversing members 42 are rotatably engaged with the movable check pieces 232. As the movable check pieces 232 located at the same side of the support projections 231 are arranged in such a way that they can only be reversibly moved at one side against the support projections 231, the slave rolling members 4 controlled by the reversing members 42 thereof can only make a reversible semicircular movement thereat in connection with the check pieces 232. The outer surface of the cylindrical master rolling members 3 is a woolen material suitable for erasing while the outer surface of the columnar slave rolling members 4 is of a sponge material for brushing purposes.

The combination of the preferred embodiment as shown in FIGS. 1 and 2 is accomplished by first inserting both journals 41 of the slave rolling members 4 into the orifices 233 located at both sides of the support projections 231 of the supporting members 2, making sure that the reversing members 42 are in movable contact with the movable check pieces 232 at one side, and the adjacent slave rolling members 4 are in slight contact with one another; and, then, install the journals 41 of the master rolling members 3 in the orifices 221, and let the adjacent surfaces of the rolling members 3 not only slightly contact each other but also the bottom surfaces thereof contact the top surfaces of the slave rolling members 4 as well. Finally install the combined guiding members 2 separately at both ends of the section 12 of the casing 1 through the different slots 121 and 122, overlapping the cotter holes 223 of the supporting members 2 over the cotter holes 123 of the casing 1, and securing them in position with the screw bolts 100, so that, the master rolling members 3 can smoothly rotate at the outer side while the slave rolling members 4 only can make a reversible semicircular movement therein.

Figure 3A:
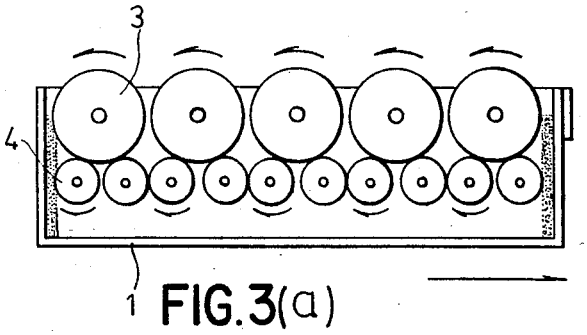
FIG. 3 (*a, b*) is an illustrative schematic plan view of the preferred embodiment of FIG. 1, indicating the moving condition of the rolling members during erasing.
Figure 3B:
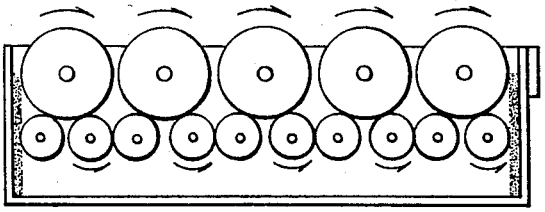

As shown in FIG. 3, when erasing over the surface of the blackboard in the right direction as shown in FIG. 3(*a*), the master rolling members 3 with the chalk dust erased rotate to the left (counterclockwise) while every other slave rolling member 4 moves to the right as the arrowheads indicate and the rests are stopped thereat. In other words, since only one of reversing member 42 provided at opposite ends of each roller 4 effectively operates to permit rotation of alternate slave rollers, every other roller remains motionless when the eraser is moved in a particular direction (i.e., left or right) due to locking engagement of their reversing member with the associated check piece 232, while the other alternate rollers therebetween are allowed to rotate. These other alternate rollers rotate through approximately 180° (i.e., in a reversible semicircular arc) due to contact of their reversing members 42 against the resilient yieldable bias of the associated check piece 232 (i.e., due to the slight contact between the master and slave rollers; rotation of every other slave roller causes its associated member 42 at one end of the eraser to exert downward pressing force against its check piece; this check piece yields against its spring bias allowing partial rotation of the roller until the spring force overcomes the force exerted by the master roller on the slave roller; the slave roller thus reverses rotation caused by the restoring force of the spring acting upon the check piece and in turn on the reversing member). Simultaneously, the motionless alternate rollers are maintained stationary since the reversing members thereon located at the opposite end of the eraser exert an upwardly directed force against their associated check pieces; i.e., since the check pieces can only deflect downwards against spring bias, they effectively lock the alternate rollers in stationary position, until the rollers rotate in a reverse direction. Thus, as the rotating rolling members 4 are checked at a certain position by the movable check pieces 232 and the other rolling members 4 remain motionless when erasing occurs in one direction, the chalk dust on the surface of the master rolling members 3 is completely removed therefrom through double brushing actions. When the erasing movement is completed in the right direction, the dust-removing action is the same as that described above except that the rotation direction of the master rolling members 3 is changed and the arc movement of the slave rolling members is accomplished by the previously stationary ones as shown by the arrowheads in FIG. 3(*b*).

When the dust accumulates to a certain amount in the bottom area of the hollow section of the casing 1, the escape clack valve 112 will automatically open through the action of gravity thereof, and the accumulated dust will fall into the spare space 11 provided in both end portions, from which discharge of the dust can be made any time through the discharge door 111 at each end of the casing 1.

In order to prevent the dust thereof from being sprinkled outside of the eraser during the dust-removing operation, and also for effecting a closed structure of the eraser, the opposing inside walls of the open hollow section 12 (as shown in FIG. 1) are furnished with a soft wool for being kept in touch with the outer surface of the master roller members 3 at both sides thereof.

Having thus described the invention, it is to be understood that many embodiments thereof will suggest themselves without departing from the spirit and scope of the invention. Therefore, it is intended that the specification and drawings be interpreted as illustrative rather than in a limiting sense.

What is claimed is:

1. An automatic dust-removing eraser of a rolling-friction type for blackboards, comprising:

a casing being open along a top central part thereof to define a cavity;

a pair of supporting members respectively mounted at opposite ends of said casing;

a plurality of slave rollers rotatably mounted on said supporting members in a lower portion of said cavity; and a plurality of master rollers rotatably mounted on said supporting members in an upper portion of said cavity and in rolling contact with said slave rollers, said master rollers engageable with the blackboard to remove dust therefrom, said slave rollers being in wiping contact with the master rollers to transfer dust to the cavity.

2. An automatic dust-removing eraser according to claim 1 wherein said casing includes:

a pair of side walls extending along the cavity and a pair of guide slots of different length from each other and a cotter hole formed at opposite ends of each side wall;

a closed spare space provided in opposite end portions of said casing; and an escape clack valve and a discharge door respectively disposed in opposing transverse end walls of each said spare space so that dust accummulating within the cavity during erasing can automatically fall by gravity into one of said spare spaces through one of said escape clack valves.

3. An automatic dust-removing eraser according to claim 1 wherein said supporting members each include:

a first vertical plate having a plurality of evenly spaced orifices for receiving ends of said master rollers;

a second vertical plate attached to and spaced from said first vertical plate and having toothed portions formed at a lower end of said second plate, said toothed portions respectively including orifices provided therein for receiving ends of said slave rollers;

a pair of connecting lugs each having a cotter hole respectively provided at both ends of said first vertical plate for attachment of side walls of said casing to said supporting members;

a plurality of protruding support projections respectively provided within spaces formed between said toothed portions and a plurality of movable check pieces separately arranged at one side of said protruding support projections for making a reversible semicircular movement against said support projections in response to contact with a reversing member provided respectively at one end of and corotatable with said slave rollers in a predetermined direction to effect a reversible semicircular movement of said slave rollers for automatic dust brushing of the master roller in contact therewith.

4. An automatic dust-removing eraser according to claim 3 wherein each slave roller comprises:

a sponge material provided around an outer surface of the roller;

a journal integrally formed at opposite ends thereof for rotatably engaging said orifices of said second vertical plate; and wherein said reversing members are separately fixed to each one of said journals for contact with said movable check pieces between said protruding support projections so as to effect a reversible semicircular movement of said slave rollers for automatic dust brushing of the master roller in contact therewith.

5. An automatic dust-removing eraser according to claim 4 wherein said slave rollers are arranged with respect to said master rollers in parallel interrelated coupling arrangement so that when said master rollers rotate continuously in one direction, said slave rollers rotate in a reversible semicircular movement for brushing off the dust from the master rollers.

6. An automatic dust-removing eraser according to claim 3 wherein each master roller comprises a woolen material provided around an outer surface thereof, and a journal integrally formed at both ends for being rotatably connected to said orifices of said first vertical plate for effecting a dust erasing operation over the surface of the blackboard.

7. An automatic dust-removing eraser according to claim 1 wherein said casing includes a soft-wool material disposed on opposing inside walls of said cavity for engaging with a like surface of said master rollers so as to prevent the dust thereof from being sprinkled outside of the eraser during dust-removing operation, and to effect a closed structure of said casing.

* * * * *